US006059399A

United States Patent [19]

Suetsugu et al.

[11] Patent Number: 6,059,399

[45] Date of Patent: May 9, 2000

[54] INK-JET RECORDING APPARATUS WITH IMPROVED INK DENSITY FORMATION

[75] Inventors: Junichi Suetsugu; Kazuo Shima; Yoshihiro Hagiwara; Ryosuke Uematsu; Hitoshi Minemoto; Hitoshi Takemoto; Toru Yakushiji; Tadashi Mizoguchi, all of Niigata, Japan

[73] Assignee: NEC Corporation, Tokyo, Japan

[21] Appl. No.: 08/919,856

[22] Filed: Aug. 28, 1997

[30] Foreign Application Priority Data

Aug. 28, 1996 [JP] Japan ..... 8-227117
Aug. 28, 1996 [JP] Japan ..... 8-227243

[51] Int. Cl.[7] ..... B41J 2/06

[52] U.S. Cl. ..... 347/55

[58] Field of Search ..... 347/55, 141, 103, 347/154, 151; 399/295

[56] References Cited

U.S. PATENT DOCUMENTS 4,271,416 6/1981 Shimizu et al. .

FOREIGN PATENT DOCUMENTS 570344750 3/1982 European Pat. Off. .
59108792 5/1984 European Pat. Off. .
0 703 080 A2 9/1995 European Pat. Off. .
07242691 9/1995 European Pat. Off. .
0703080 A2 3/1996 European Pat. Off. ..... 347/55
0 786 344 A1 1/1997 European Pat. Off. .
WO 93/11866 6/1993 WIPO .

OTHER PUBLICATIONS

TonerJet, by Array Printers AB, 1990.

*Primary Examiner*—John Barlow
*Assistant Examiner*—Raquel Yvette Gordon
*Attorney, Agent, or Firm*—Hutchins, Wheeler & Dittmar

[57] ABSTRACT

A head body is shaped to project toward an ink ejection side, and formed along the projection with an ink channel for circulating the ink, at the vertex of the front end of which an opening is formed for ejecting the ink from the ink channel. An ejection electrode is formed along the front end of the head body. Its front end reaches the opening. An electrophoresis electrode is secured in the ink channel at a position opposite to the opening, and supplied with a voltage for moving the toner particles in the ink flowing in the ink channel to the front end of the ejection electrode with the electrophoresis effect. An opposite electrode is positioned opposite to the ink ejection side. A drive circuit drives the opposite electrode when the electrophoresis electrode is driven, and generates voltage for attracting the toner particles toward the opposite electrode with Coulomb force that is generated by an electric field acting between the ejection electrode and the electrophoresis electrode, and the opposite electrode.

9 Claims, 7 Drawing Sheets

INK-JET RECORDING APPARATUS WITH IMPROVED INK DENSITY FORMATION

BACKGROUND OF THE INVENTION

1. Field of the Invention

The present invention relates to an electrostatic ink-jet recording apparatus in which charged particulate material in ink is deposited on a recording medium with the action of electrostatic force for recording, and, more particularly, to an electrostatic ink-jet recording apparatus which enables it to simplify its manufacturing process.

2. Description of the Prior Art

Conventionally, as described in PCT Publication Number WO 93/11866, an electrostatic ink-jet recording apparatus has an electrostatic ink-jet recording head, and an opposite electrode positioned behind recording paper and for producing an electric field between the recording paper and the ink-jet recording head. The ink-jet recording head has, as shown in FIG. 1, a head body 40, and ink channels 41 and 42 formed within the head body 40 and through which ink liquid supplied from an ink tank or the like flows. The ink channel 41 supplies the ink to the front end of the head body 40. The ink liquid supplied to the front end is then introduced into the ink channel 42 along an ink director 43. This forms a circulating path of ink liquid.

A plurality of ejection electrodes 45 and insulators 48 are alternately formed on the inclined surface of the head body 40. Each ejection electrode 45 is driven by each of drive sources 49 when ejecting the ink. Each of the front end 46 of the ejection electrode 45 is formed with a blade 47 projecting from the end of the ink channel 41 and projects therefrom. The blade 47 projects in the direction of ink ejection, and is necessary for directing the front end 46 toward the direction of ink ejection. This makes parallel the direction of ink ejection and the direction of the front end 46 of the ejection electrode. The front end 46 of the ejection electrode faces an opposite electrode (not shown). Although it does not describe how to form the ejection electrode, it is anticipated that it is formed by laminating conductors. The ink liquid in the ink channel 41 is supplied to the front end 46 of the ejection electrode by its surface tension. This forms an ink meniscus at the front end 46.

The ink liquid contains a charged particulate material for coloring. Hereinafter, the charged particulate material is called a toner particle (or toner particles). While the toner particles are positively charged by zeta potential, the ink liquid maintains to be electrically neutral in a state where no voltage is applied to the ejection electrode 45. The polarity of zeta potential depends on the characteristics of the toner particle.

When a positive voltage is applied to the ejection electrode 45, positive potential increases in the ink liquid. At the moment, the toner particles move in the ink liquid toward the front end 46 of the ejection electrode 45 by an electric field acting between the ejection electrode 45 and the opposite electrode (not shown). When the toner particles reach the front end 46, they are strongly attracted toward the opposite electrode by an electric field acting between the front end 46 and the opposite electrode. When Coulomb force acting between the toner particles concentrated at the front end 46 of the ejection electrode and the opposite electrode significantly exceeds the surface tension of the ink liquid, agglomerations of toner particles accompanying small amount of the ink liquid fly from the front end position of the ejection electrode toward the opposite electrode, and deposit on the surface of a recording medium. Thus, aggregations of charged particulate material flies one after another from the front end of the ejection electrode by applying voltage to the ejection electrode, thereby printing being performed.

The conventional ink-jet recording head shown in FIG. 1 should orient the front end 46 of the ejection electrode 45 so that the ink is ejected in the predetermined direction. Thus, the blade 47 for the orientation should be formed on the end of the ink channel 41. However, the ink must move under the blade 47 in order that the ink from the ink channel 41 reaches the front end of the ejection electrode 45. This extends the distance for the ink liquid and the toner particles therein to reach the front end 46, so that ejection of the ink becomes unstable. In addition, the extended distance calls for the drive source 49 to apply a very high voltage to the election electrode. Higher pulse voltage applied to the ejection electrode causes a problem making difficult fabrication of a driver. Further, there arises a problem that, when pulse driving is performed at a high voltage, noise may be induced in peripheral electronics, leading to malfunction.

In addition, since the ink circulating path of the ink channels 41 and 42 is separated from a point for ejecting the ink or the front end 46 of the ejection electrode, many of toner particles in the ink channel 41 fail to reach the front end 46, but return to the ink channel 42 through the director 43, so that a sufficiently dense image cannot be recorded.

SUMMARY OF THE INVENTION

An object of the present invention is to provide a reliable, inexpensive electrostatic ink-jet recording apparatus that can stabilize flight of toner.

The ink-jet recording apparatus according to the present invention performs printing on a recording medium by applying an electric field to ink containing charged toner particles, and causing the ink containing the toner particles to fly under Coulomb force acting on the toner particles. It comprises a head body, an opposite electrode, and a drive circuit.

The head body has a projecting portion projecting toward an ink ejection side, and is provided with an ink channel for circulating the ink and an opening positioned in the ink channel. The ink channel is located under and along the surface of the projecting portion. The opening is located at the vertex of the projecting portion for ejecting the ink from the ink channel. Ejection electrodes are located on the surface of the projecting portion of the head body. Their front ends reach or extend to the opening. An electrophoresis electrode is secured in the ink channel at a position facing to the opening, and supplied with a voltage for moving the toner particles in the ink flowing in the ink channel to the front ends of the ejection electrodes with the electrophoresis effect. The opposite electrode is positioned opposite to the ink ejection side. The drive circuit drives the opposite electrodes when the electrophoresis electrode is driven, and generates ejection voltages for attracting the toner particles toward the opposite electrode with Coulomb force that is generated by an electric field acting between the ejection electrode and the electrophoresis electrodes, and the opposite electrode.

The front ends of the ejection electrodes have first and second ejection electrodes that are positioned opposite each other at the opening of the head body.

The drive circuit separately applies drive pulses to the first ejection electrodes. Alternatively, it selectively supplies drive voltage to either one of the first or second ejection electrodes, or to both of the first and second ejection electrodes. This allows it to control the size of recording dot, or the density of recorded image.

The front ends of the ejection electrodes may have a plurality of first and second ejection electrodes that are alternately positioned and bent at the center of the opening. Recording resolution can be doubled by separately controlling them.

DETAILED DESCRIPTION OF THE PREFERRED EMBODIMENTS

Figure 2:
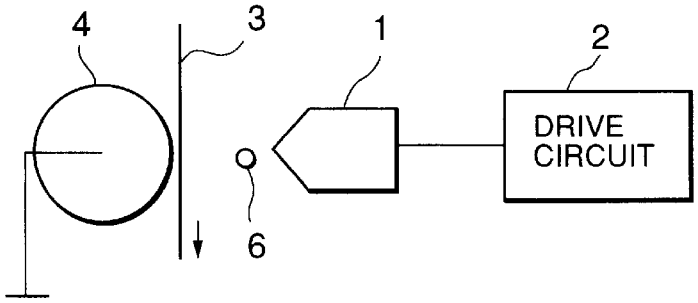
FIG. 2 is a schematic perspective view showing an electrostatic ink-jet recording apparatus according to a first embodiment of the present invention.

Referring to FIG. 2, the electrostatic ink-jet recording apparatus according to a first embodiment of the present invention comprises an electrostatic ink-jet recording head (hereinafter called the "recording head") 1, a drive circuit 2 for driving the recording head 1, and a roller-shaped opposite electrode 4 positioned at the ink liquid ejection side of the recording head 1. The opposite electrode 4 is grounded. When the drive circuit 2 drives the recording head 1, the ink liquid flies out from the recording head 1 by electrostatic force between the recording head 1 and the opposite electrode 4, reaches recording paper 3, and is recorded thereon.

Figure 3:
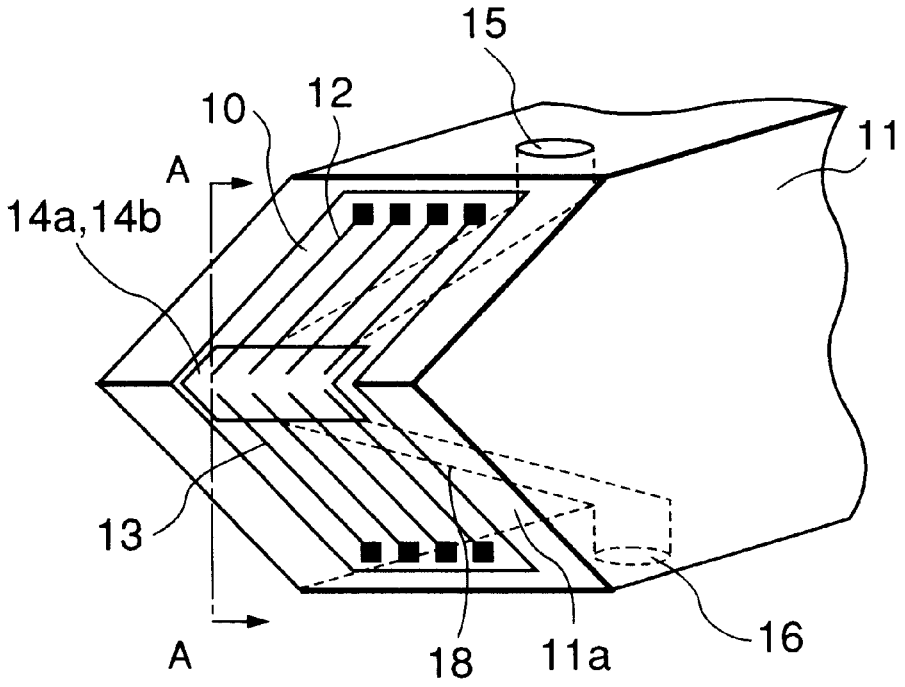
FIG. 3 is a perspective view of a recording head of the electrostatic ink-jet recording apparatus shown in FIG. 2.

In FIG. 3, the recording head 1 has a head body 11 and a base film 10 of an insulating material fixed to the head body 11. The head body 11 has an angular projecting portion 11*a* projecting toward an ink ejection side, and is provided with an ink channel 18 for circulating the ink and slit openings 14*a* and 14*b* positioned in the ink channel. The ink channel 18 is located under and along a surface of the angular projecting portion 11*a*. The openings are located at the vertex of the angular projecting portion 11*a* for ejecting the ink from the ink channel 18. The base film 10 is fixed on the surface of the angular projecting portion 11*a* of the head body 11. The slit openings 14*a* and 14*b* are formed on the base film 10. The base film 10 is folded back through the slit opening 14*a*. Ejection electrodes 12 and 13 are formed on the surface of the base film 10, and connected to the drive circuit 2 of FIG. 2. The front ends of the ejection electrodes 12 and 13 are located at the slit opening 14*a* and opposite each other.

Figure 4:
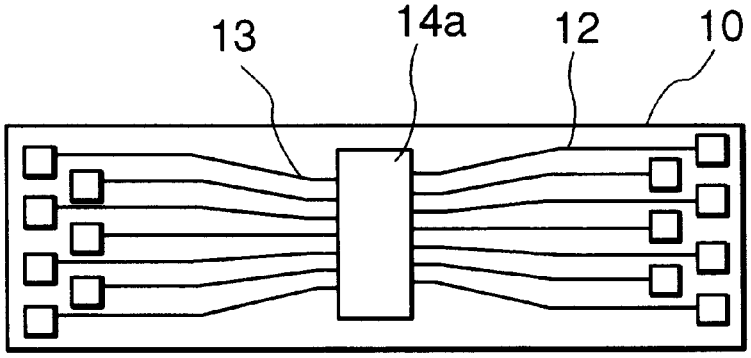
FIG. 4 is a plan view of a base film used for the recording head of FIG. 3.

The head body 11 is made of an insulating material such as plastics. The opening 14*b* forms an ink output end of the angular projecting portion 11*a*. As shown in FIG. 4, the base film 10 is tape automated bonding (TAB) tape in which the ejection electrodes 12 and 13 consisting of a conductive material are integrally formed on an insulating material such as polyimide, and has a thickness of about 50 $\mu$m. The slit opening 14*a* is formed at the same location as the slit opening 14*b* at the end of the angular projecting portion 11*a* of the head body 11.

Figure 5:
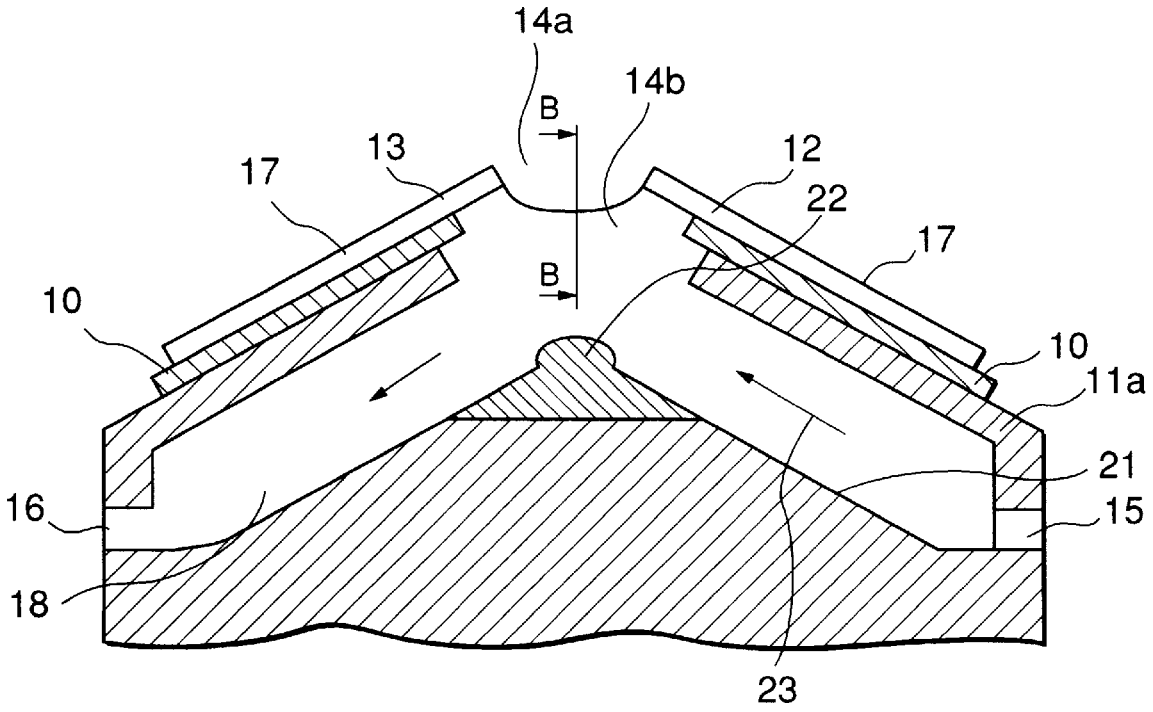
FIG. 5 is a sectional view along line A—A of the recording head of FIG. 3.

The electrodes 12 and 13 are made of a conductive material such as copper pattern plated in a thickness of 20–30 $\mu$m on the base film 10. They are arranged, for example, in a pitch of 300 dpi or at an interval of about 85 $\mu$m. The surface of the ejection electrodes 12 and 13 is coated, as shown in FIG. 5, by an insulating coating member 17 with a thickness of 10 $\mu$m or less. The insulating coating member 17 is formed by chemically depositing Palylen resin.

The head body 11 is previously worked with an ink supply port 15 and an ink discharge port 16. As shown in FIG. 5, an ink channel 18 is located under the surface of the angular projecting portion 11*a* and on an inner wall 21. The ink supply port 15 and the ink discharge port 16 are connected to the ink channel 18. The ink flows from the ink supply port 15 to the ink discharge port 16 through the ink channel 18. The slit openings 14*a* and 14*b* are positioned on the vertex of the inner wall 21, and are formed in the middle of the ink channel 18. The ink supply port 15 is connected to an ink tank (not shown) through a tube, and applies a pressure of about 1 cm $H_2O$ to forcibly circulate the ink liquid.

The ink liquid is petroleum organic solvent (isoparaffin) dispersed with colored thermoplastic particulates, so-called toner, together with antistatic agent. The toner is apparently charged in positive potential by zeta potential.

Figure 1:
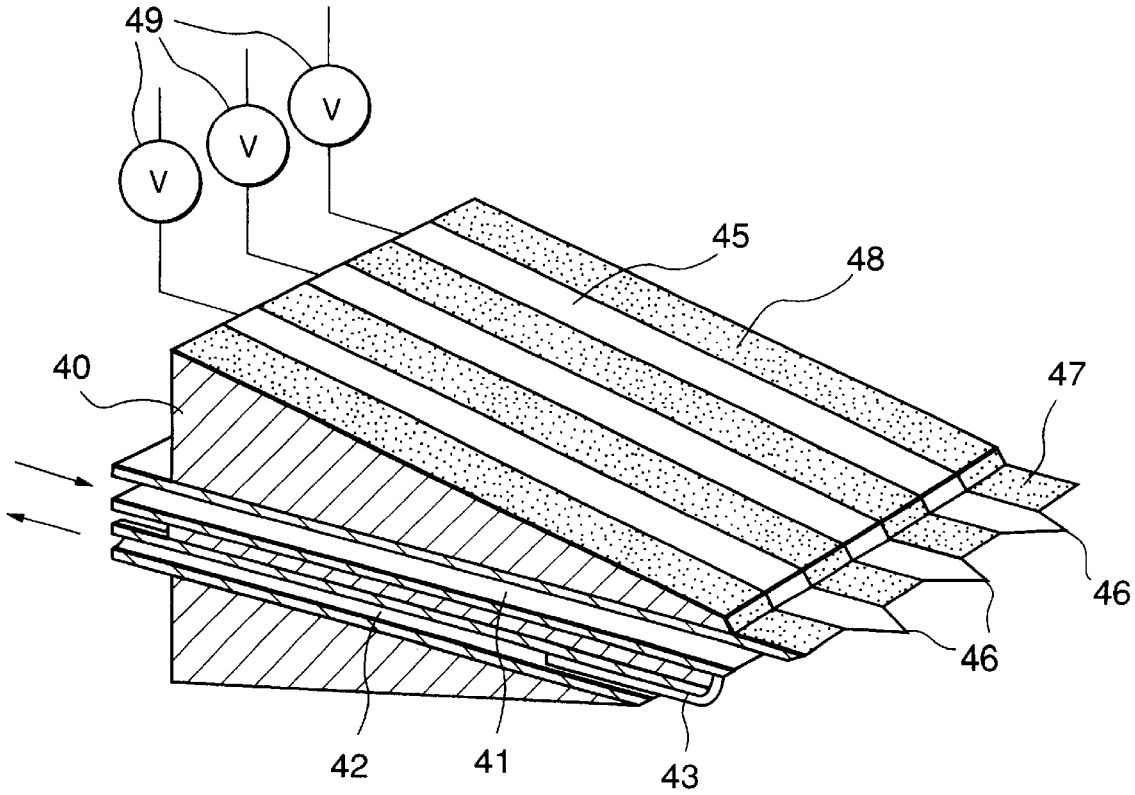
FIG. 1 PRIOR ART
FIG. 1 is a perspective view showing a recording head of a conventional electrostatic ink-jet recording apparatus.

In FIG. 5, an electrophoresis electrode 22 is secured on the inner wall 21 of the head body 11. The electrophoresis electrode 22 is secured on a position facing to the slit openings 14*a* and 14*b*, and formed straight parallel to the arranging direction of the front ends of the ejection electrodes 12 and 13. The front ends of the ejection electrodes 12 and 13 are positioned between the electrophoresis electrode 22 and the opposite electrode 4 of FIG. 1. Since the electrophoresis electrode 22 is positioned in the flow of the ink liquid in the ink channel 18, the ink liquid containing the toner particles contacts the electrophoresis electrode 22. The electrophoresis electrode 22 is connected to the drive circuit 2 shown in FIG. 2.

Figure 6:
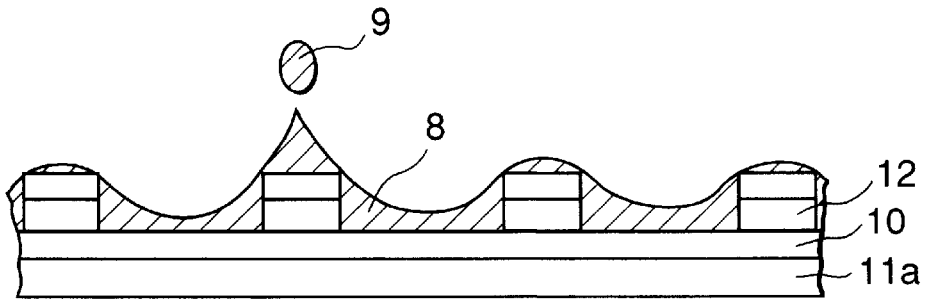
FIG. 6 is a sectional view along line B—B of FIG. 5.

The drive voltage is applied from the drive circuit 2 in FIG. 2 to a plurality of ejection electrodes 12 secured on one side of the angular projecting portion 11*a*, but not to the other plurality of ejection electrodes 13. The ejection electrodes 13 are provided for forming ink meniscus. That is, the ink meniscuses are independently formed between the respective ejection electrodes 12 and the opposing ejection electrodes 13 by the surface tension of the ink as shown in FIG. 6. The ink meniscus is always formed. It is because the ink in the recording head is under negative pressure, and flows in the ink channel 18 as ink flow with a constant flow rate, and because the front ends of the ejection electrodes 12 and 13 are positioned at the slit openings in the way to the ink channel 18.

The electrophoresis electrode 22 is applied with a voltage (for example, 2.0 kV) with the same polarity as the toner potential from the drive circuit 2 of FIG. 2. Therefore, the toner particles in the ink, supplied from the ink supply port 15 and flowing through the ink channel 18, is moved toward the front ends of the ejection electrodes 12 and 13 under the electrophoresis by the electric field between the electrophoresis electrode 22 and the opposite electrode 4 of FIG. 2. Thus, toner particle concentration near the ejection electrodes 12 and 13 becomes relatively higher than in the upstream of the ink flow 21 by the movement of toner particles by the electrophoresis in addition to supply of the toner particles near the ejection electrodes 12 and 13 under force circulation by a pump. Furthermore, absorbed on the electrophoresis electrode 22 are counter ions, which are generated along with the movement of the toner particles by the electrophoresis, which have the opposite polarity to the charge of toner, and which are moved in the direction opposite to that of the toner particles.

Therefore, when high voltage pulses of 1.1 kV are applied to any ejection electrode 12 at the same time a voltage is applied to the electrophoresis electrode 22, the charged toner is concentrated at the front end of meniscus 8 formed at the front end of that ejection electrode 12. Sufficient amount of toner group 9 flies toward the opposite electrode 4 or the recording paper 3 under the synergistic effect of the electric field between the electrophoresis electrode 22 and the opposite electrode 4 of FIG. 2, and the electric field generated on the ejection electrode 12. Furthermore, the ink is forcedly discharged to the ink discharge port 16 together with surplus toner particles. The toner deposited on the recording paper and forming recording dots is heated and fixed by a heater.

As described above, according to the first embodiment of the present invention, the head body 11 has the angular projecting portion projecting toward the ink ejection side, and the ink channel 18 is located under and along the surface of the projecting portion 11*a* for circulating the ink and the slit opening 14*b* being positioned at the vertex of the projection portion 11*a* for ejecting the ink. The ejection electrodes 12 and 13 are located on the surface of the projecting portion 11*a* and reach the slit opening 14*b*. Accordingly, the front ends of the ejection electrodes 12 and 13 which are the points for ejecting the ink are adjacent to the ink circulating path (ink channel 18), and can concentrate sufficient amount of ink particles at the front end of the ejection electrode.

In addition, the electrophoresis electrode 22 is secured facing to the slit opening 14*b* via the ink channel 18 as shown in FIG. 5, and supplied with a voltage for moving the toner particles in the ink flowing through the ink channel 18 toward the front end of the ejection electrode 12 under the electrophoresis effect. Consequently, it is possible to efficiently concentrate at the front end of the ejection electrode 12 the ink particles in the ink circulating in the ink channel 18, so that not only stable recording can be attained, but also the drive voltage can be lowered for the electrophoresis electrode and the ejection electrode.

Figure 7:
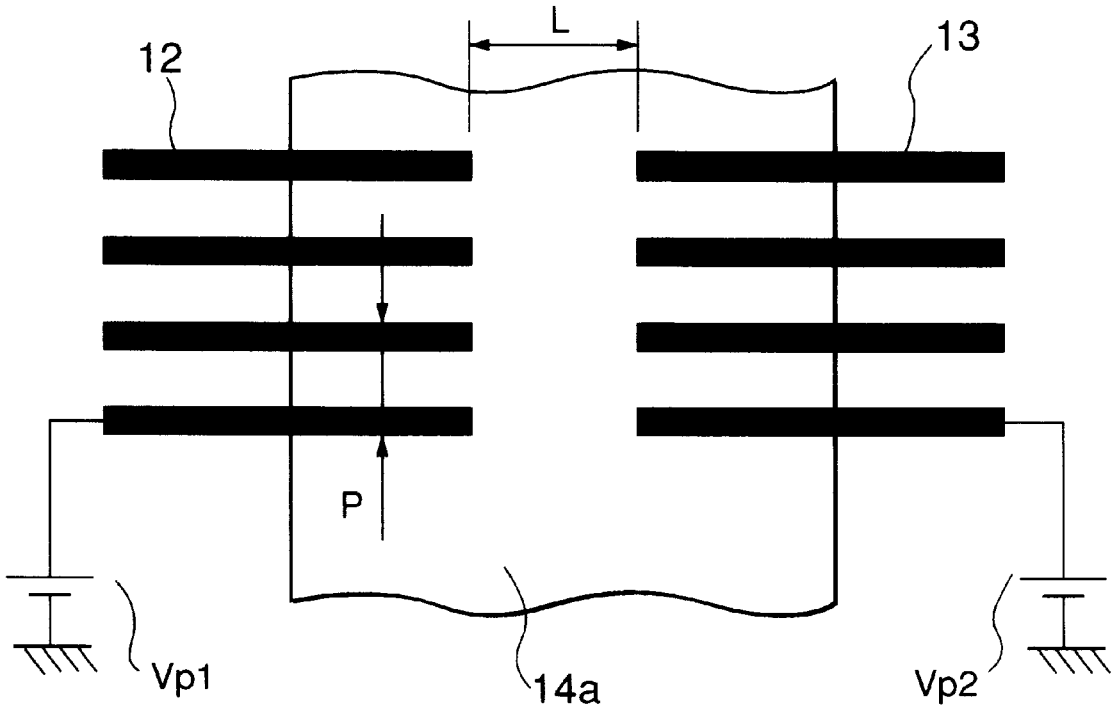
FIG. 7 is a partial plan view of the recording head of FIG. 3 when viewing from the ink liquid output side.
Figure 8:
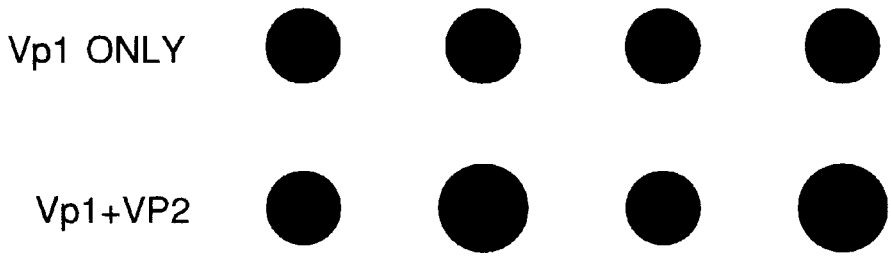
FIG. 8 is a plan view showing record samples when the recording head of FIG. 7 is used.

FIG. 7 is a partial plan view of the recording head 1 of FIG. 3 when viewing it from the ink liquid output side. FIG. 8 is a conceptual diagram of record samples by using the recording head of FIG. 7. The ejection electrodes 12 and 13 are arranged to have a distance L between the electrode ends in integer times of the pitch P between the electrode electrodes. High voltage drive pulses are applied to the ejection electrodes 12 and 13 opposite each other.

The drive circuit 2 of FIG. 2 generates one or both of drive voltages Vp1 and Vp2 depending on selection of recording dot size or recording density. As shown in FIG. 8, only recording dots with the same size are obtained in the recording only with the drive voltage Vp1 applied to the ejection electrode 12, while recording dots in two different sizes can be obtained by applying or not applying the drive voltage Vp2 together with the drive voltage Vp1 to the other ejection electrode 13 from the drive circuit 2 of FIG. 2. This is because, when the drive voltage Vp2 is applied together with the drive voltage Vp1, the ink liquid is ejected from the ejection electrode 12 and the opposite ejection electrode 13 to form large dots on the recording paper. This enables the drive circuit 2 to adjust the density of a recorded image.

Figure 9:
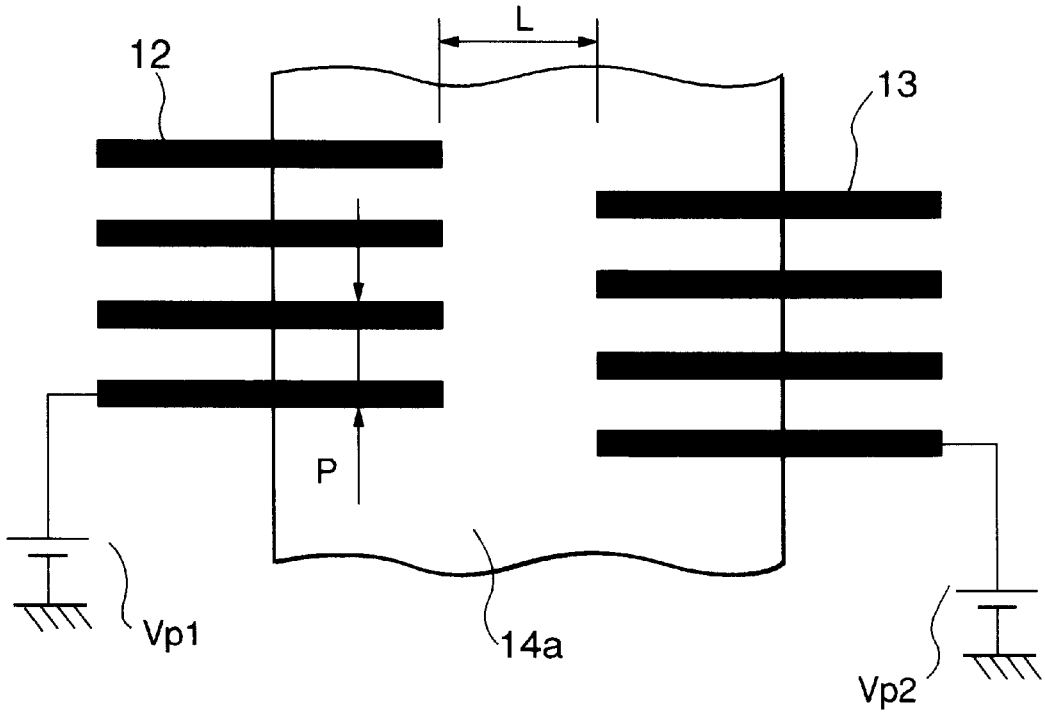
FIG. 9 is a plan view of a recording head using ejection electrodes in an arrangement different from FIG. 7, when viewing it from the ink liquid output side.

FIG. 9 is a plan view of a recording head using ejection electrodes in an arrangement different from FIG. 7. In the figure, the ejection electrodes 12 and 13 are arranged in stagger, instead of opposite each other. The ejection electrodes 12 and 13 are separately driven, and the drive voltage Vp1 and Vp2 are independently generated according to drive data. In this embodiment, the recording density is improved by two times when compared with FIG. 7.

Figure 10:
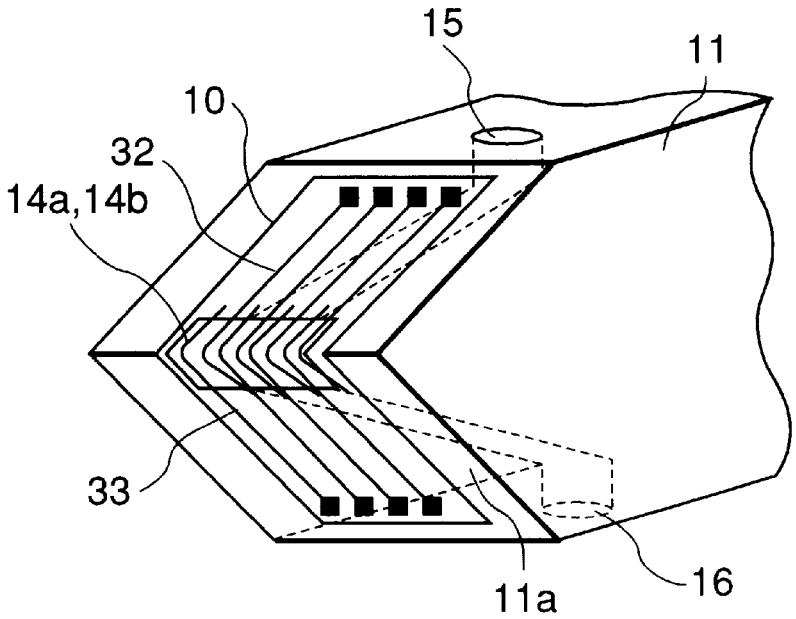
FIG. 10 is a perspective view showing a recording head of an electrostatic ink-jet recording apparatus according to a second embodiment.

FIG. 10 is a perspective view showing a recording head used for the second embodiment of the present invention. The second embodiment is the same as the first embodiment shown in FIG. 3 except for the arrangement of ejection electrodes.

In FIG. 10, the ejection electrodes 32 and 33 are arranged in stagger, and bent at the center of slit openings 14*a* and 14*b* to cover the respective openings 14*a* and 14*b*. The ejection electrodes 32 and 33 are separately driven by the drive circuit 2 of FIG. 2.

The second embodiment has an advantage to stably form ink meniscuses. That is, since the meniscuses are formed along the bending sections of the ejection electrodes 32 and 33, the shape of ejection electrodes 32 and 33 determines the shape of meniscus, so that the ink particles can be stably ejected. In addition, the pitch of dots printed on the recording paper is twice FIG. 3. When it is intended to enlarge the dot size or to increase the density of a recorded image, the drive circuit of FIG. 2 is sufficient to supply the drive voltage to both the adjacent ejection electrodes 12 and 13.

Figure 11:
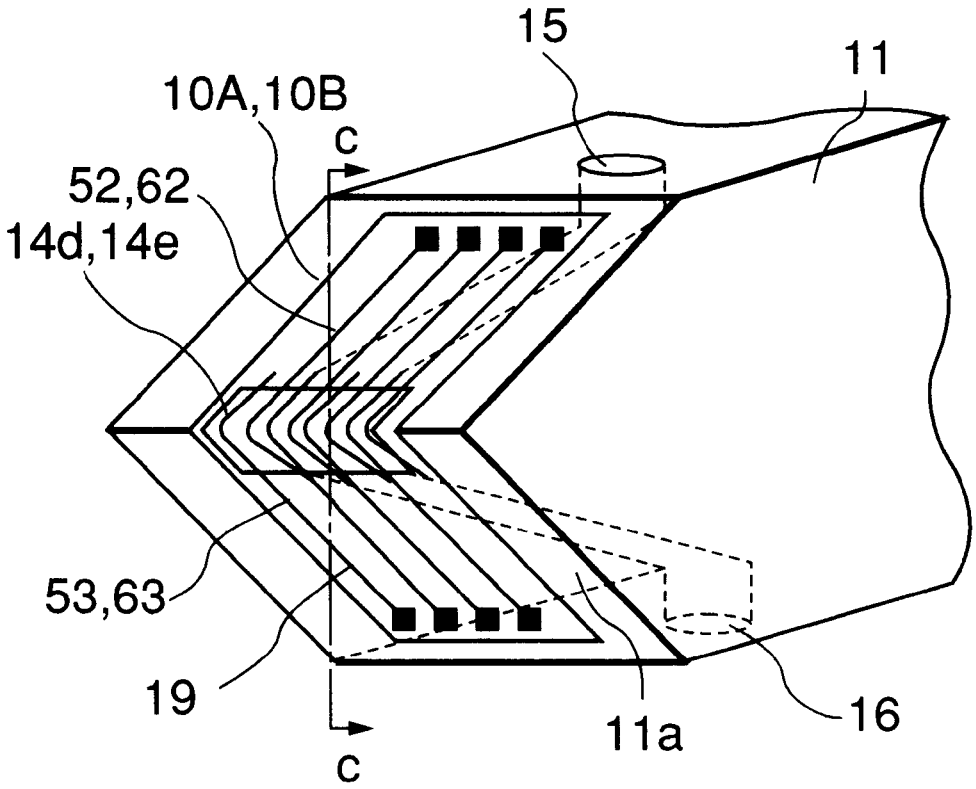
FIG. 11 is a perspective view showing a recording head of an electrostatic ink-jet recording apparatus according to a third embodiment.
Figure 12:
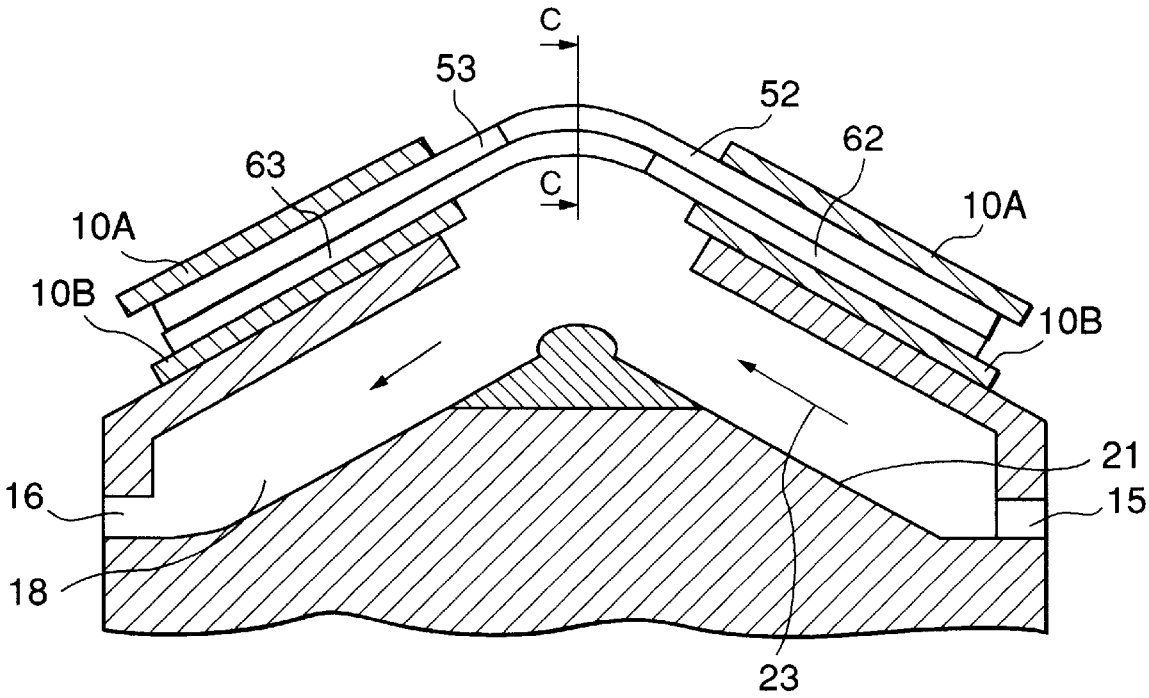
FIG. 12 is a sectional view along line C—C of the recording head of FIG. 11.
Figure 13:
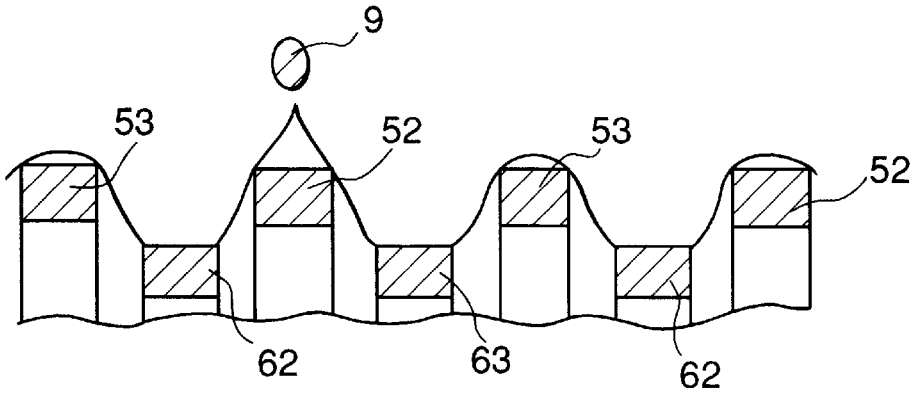
FIG. 13 is a sectional view along line D—D of the recording head of FIG. 12.

FIG. 11 is a perspective view of a recording head used for a third embodiment of the present invention, FIG. 12 is a sectional view of FIG. 11, and FIG. 13 is a sectional view along line B—B in FIG. 12.

The recording head of this embodiment differs from the second embodiment of FIG. 11 in that it uses two insulating base films 10A and 10B formed with ejection electrodes. The base films 10A and 10B are adhered in such a manner that the ejection electrode sides are opposite each other.

Formed on the surface of the base film 10A are a plurality of ejection electrodes 52 and 53 with slit openings 14*d* therebetween. The ejection electrodes 52 and 53 are arranged in the same manner as the ejection electrodes 32 and 33 of the second embodiment shown in FIG. 10. The surface of the ejection electrodes 52 and 53 is coated with an insulating coating member 17.

Formed on the surface of the base film 10B are a plurality of ejection electrodes 62 and 63 with slit openings 14*e* therebetween. The slit openings 14*e* overlap the slit openings 14*d*. The ejection electrodes 62 and 63 are arranged in the same manner as the ejection electrodes 32 and 33 of the second embodiment shown in FIG. 10. However, as shown in FIG. 13, the ejection electrodes 62 and 63 are arranged in stagger not to overlap the ejection electrodes 52 and 53. The surface of the ejection electrodes 62 and 63 is also coated with an insulating coating member 17.

As shown in FIGS. 12 and 14, the base film 10A is formed on the base film 10B. Accordingly, the ejection electrodes 52 and 53 are closer to the opposite electrode than the ejection electrodes 62 and 63. Then, ejection points 50 are formed in the ejection electrodes 52 and 53 as shown in FIG. 13. Since ink meniscuses 8 are unevenly arranged along the ejection electrodes 52 and 53 as well as 62, 63, the ink meniscuses are stably formed.

A first advantage of the third embodiment lies in that ejection can be carried out only through intended ejection points, thereby reliable toner ejection being attained. It is because the ink meniscuses formed at the intended ejection points 50 are separated and independent from those at adjacent ejection points so that behavior of ink at the ejection point 50 does not affect the adjacent ejection point.

A second advantage of the third embodiment lies in that the toner particles are ejected without time lag. It is because the toner particles are held in the meniscuses previously formed at the front ends of the ejection electrodes and the ejection points.

The present invention is not limited to the embodiments described above. For example, although the projecting portion is the angular projecting portion 11*a* with a predetermined angle at the front end of which slit openings 14*a* and 14*b* are formed, as shown in FIG. 3, the projecting portion is sufficient to have a shape projected toward the ink ejection side. For example, it may be a curved front end without angle. In this case, the slit openings are formed at the vertex of the curved front end.

What is claimed is:

1. An electrostatic ink-jet recording apparatus for performing printing on a recording medium by applying an electric field to ink containing charged toner particles, and by causing the ink containing said toner particles to fly under Coulomb force acting on said toner particles, said recording apparatus comprising:

a head body having an angular projecting portion projecting toward an ink ejection side and being provided with an ink channel located inside said angular projecting portion for circulating the ink and provided with an opening connected to said ink channel, said opening being positioned at a vertex of said angular projecting portion for ejecting the ink from said ink channel;

a base film which is formed with holes at positions corresponding to said opening and folded back through said opening, being fixed on an outer surface of said projecting portion;

ejection electrodes formed on said base film, said ejection electrodes having front ends extending over said opening;

an electrophoresis electrode secured in said ink channel at a position facing to said opening, and supplied with a voltage for moving said toner particles in the ink flowing in said ink channel to the front ends of said ejection electrodes with an electrophoresis effect;

an opposite electrode positioned opposite to said ink ejection side, and a drive circuit driving said ejection electrodes when said electrophoresis electrode is driven, for attracting said toner particles toward said opposite electrode with Coulomb force that is generated by an electric field acting between said ejection electrodes and said electrophoresis electrode, and said opposite electrode.

2. The electrostatic ink-jet recording apparatus as set forth in claim 1, wherein said ejection electrodes have first and second ejection electrodes, front ends of said first ejection electrodes being positioned opposite to front ends of said second ejection electrodes, with a spacing between said first ejection electrodes and said second ejection electrodes disposed on said opening.

3. The electrostatic ink-jet recording apparatus as set forth in claim 2, wherein said drive circuit separately applies drive pulses to said first ejection electrodes.

4. The electrostatic ink-jet recording apparatus as set forth in claim 2, wherein said drive circuit selectively supplies drive voltages to either said first ejection electrodes or said second ejection electrodes, or to both of said first and second ejection electrodes.

5. The electrostatic ink-jet recording apparatus as set forth in claim 1, wherein said ejection electrodes have a plurality of first and second ejection electrodes having front ends, the front ends of said first ejection electrodes being staggered with respect to the second ejection electrodes in a direction parallel to the vertex and bent across said opening.

6. The electrostatic ink-jet recording apparatus as set forth in claim 5, wherein said drive circuit separately applies drive pulses to said first and second ejection electrodes.

7. The electrostatic ink-jet recording apparatus as set forth in claim 5, wherein said drive circuit selectively supplies drive voltages to either said first ejection electrodes and said second ejection electrodes, or both of said first and second ejection electrodes.

8. The electrostatic ink-jet recording apparatus as set forth in claim 1, wherein said base film consists of a first base film and a second base film, which are laminated, with the ejection electrodes being formed on each of said first base film and said second base films.

9. The electrostatic ink-jet recording apparatus as set forth in claim 8, wherein said ejection electrodes on said first base film are arranged alternately with said ejection electrodes on said second base film.

* * * * *